US011420454B2

(12) United States Patent
Yatsunami et al.

(10) Patent No.: US 11,420,454 B2
(45) Date of Patent: Aug. 23, 2022

(54) RECORDING APPARATUS

(71) Applicant: SEIKO EPSON CORPORATION, Tokyo (JP)

(72) Inventors: Tetsuji Yatsunami, Okaya (JP); Shingo Waki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/236,142

(22) Filed: Apr. 21, 2021

(65) Prior Publication Data

US 2021/0331498 A1 Oct. 28, 2021

(30) Foreign Application Priority Data

Apr. 24, 2020 (JP) ..... JP2020-077478

(51) Int. Cl.
*B41J 13/00* (2006.01)

(52) U.S. Cl.
CPC ..... *B41J 13/0009* (2013.01)

(58) Field of Classification Search
CPC .... B41J 29/02; B41J 11/0045; B41J 13/0009; B41J 3/60; B41J 13/0018; B41J 11/007; B65H 85/00
See application file for complete search history.

(56) References Cited

U.S. PATENT DOCUMENTS

2016/0116881 A1* 4/2016 Kodama ..... B41J 11/0045 399/407
2016/0370748 A1* 12/2016 Tani ..... B65H 5/062
2017/0282609 A1* 10/2017 Yatsunami ..... B41J 13/0009
2017/0334219 A1* 11/2017 Ito ..... B41J 11/0055
2018/0272755 A1 9/2018 Komuro et al.

FOREIGN PATENT DOCUMENTS

JP 2012-152919 8/2012
JP 2017-178484 10/2017
JP 2017-178485 10/2017
JP 2018-158776 10/2018
JP 2019-196273 11/2019

* cited by examiner

*Primary Examiner* — Jannelle M Lebron
(74) *Attorney, Agent, or Firm* — Workman Nydegger

(57) ABSTRACT

A control section of a recording apparatus is configured to execute control of overlapping transportation in which a preceding medium and a following medium are transported in a state in which a rear end region of the preceding medium and a leading end region of the following medium overlap at least in a partial section in an upper transport route, and determines an overlapping dimension Lk that is a dimension, by which the rear end region of the preceding medium and the leading end region of the following medium overlap, in accordance with a route dimension Ld from a third feed roller pair to an edge of an introducing port in a second direction, when executing the control of the overlapping transportation.

8 Claims, 9 Drawing Sheets

RECORDING APPARATUS

The present application is based on, and claims priority from JP Application Serial Number 2020-077478, filed Apr. 24, 2020, the disclosure of which is hereby incorporated by reference herein in its entirety.

BACKGROUND

1. Technical Field

The present disclosure relates to a recording apparatus that performs recording on a medium.

2. Related Art

In recording apparatuses such as facsimile devices and printers, to improve throughput of recording processing, a preceding medium transported first and a following medium transported after the preceding medium may be synchronously transported in a state where a rear end region of the preceding medium and a leading end region of the following medium overlap (for example, JP-A-2012-152919). Such transportation of media is hereinafter referred to as "overlapping transportation".

In overlapping transportation, when a margin dimension in a rear end region of a preceding medium is greater, it is possible to increase an overlapping dimension, which is advantageous from the viewpoint of improvement in throughput. However, in a case in which a switchback route for performing recording on both surfaces of a medium is provided, when an overlapping dimension increases, there is a possibility of a preceding medium difficult to be guided to the switchback route. In recording apparatuses of the related art, no particular consideration is given to achieve both overlapping transportation and switchback transportation.

SUMMARY

To solve the aforementioned problem, a recording apparatus of the disclosure includes: a recording section performing recording on a medium; a first feed roller pair that is positioned in a second direction and feeds the medium in a first direction, in which the second direction is in an upstream of the recording section and is opposite to the first direction which is a medium transport direction when recording is performed by the recording section; a second feed roller pair that is positioned in the first direction which is in a downstream of the recording section and that feeds the medium in the first direction; a third feed roller pair that is positioned in the first direction which is in a downstream of the second feed roller pair and that is configured to rotate in a first rotational direction and in a second rotational direction opposite to the first rotational direction, in which the first rotational direction is a rotational direction when the medium is fed in the first direction and discharged; an upper transport route that is a medium transport route extending from the first feed roller pair to the third feed roller pair; a lower transport route that is a transport route positioned vertically below the upper transport route and that is a route in which the medium is transported toward the second direction, in which the medium is introduced by rotation of the third feed roller pair in the second rotational direction from an introducing port positioned in the second direction which is in an upstream of the third feed roller pair; a reverse route which is positioned in the second direction with respect to the first feed roller pair and coupled to the lower transport route and in which a surface of the medium is reversed; and a control section controlling the first feed roller pair, the second feed roller pair, and the third feed roller pair, in which the control section is configured to execute control of overlapping transportation in which a preceding medium and a following medium are transported in a state in which a rear end region of the preceding medium and a leading end region of the following medium overlap at least in a partial section in the upper transport route, and the control section determines an overlapping dimension Lk that is a dimension, by which the rear end region of the preceding medium and the leading end region of the following medium overlap, in accordance with a route dimension Ld from the third feed roller pair to an edge of the introducing port in the second direction, when executing the control of the overlapping transportation.

DESCRIPTION OF EXEMPLARY EMBODIMENTS

Figure 1:
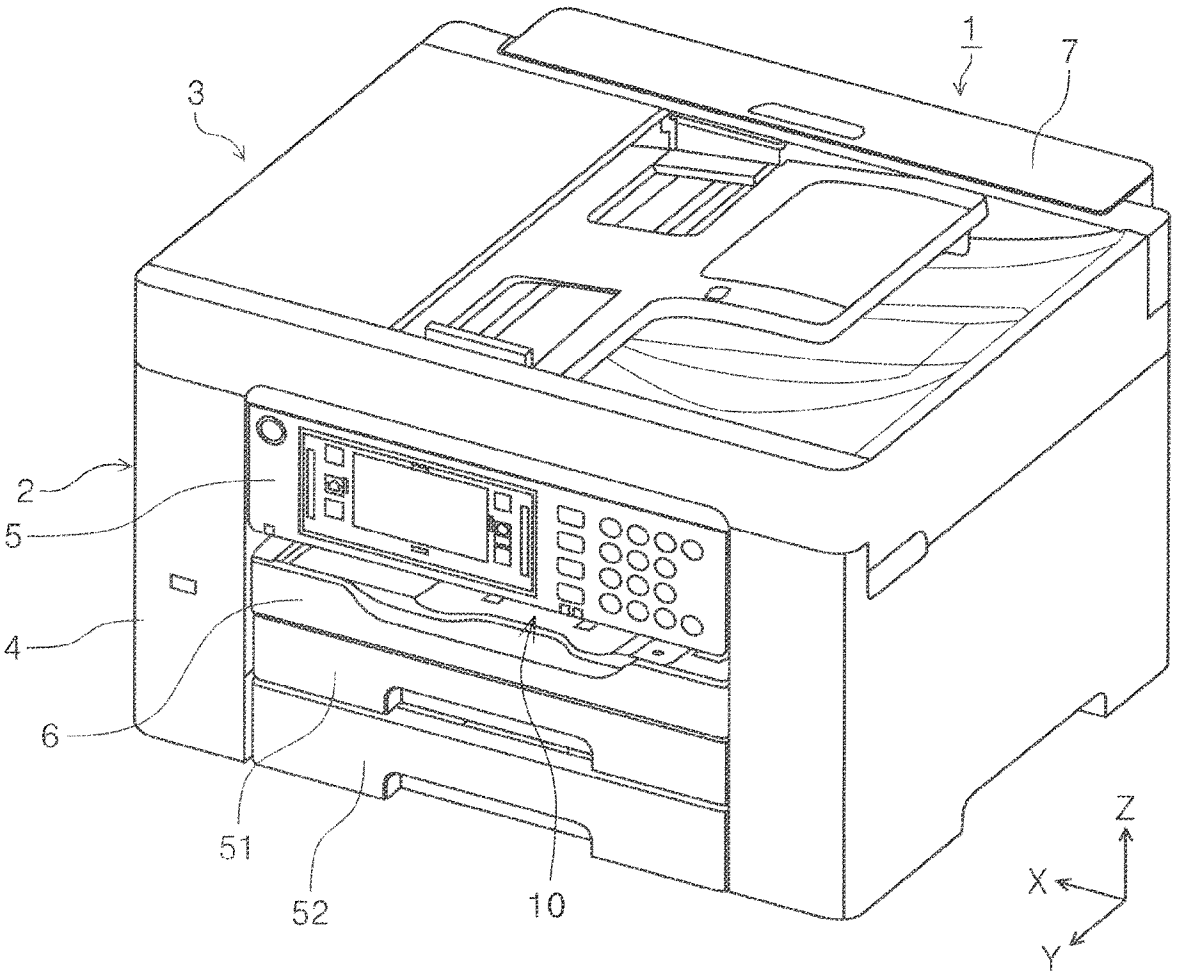
FIG. 1 is a perspective view of a printer viewed from the front side.

The disclosure will be schematically described below.

A recording apparatus according to a first aspect includes: a recording section performing recording on a medium; a first feed roller pair that is positioned in a second direction and feeds the medium in a first direction, in which the second direction is in an upstream of the recording section and is opposite to the first direction which is a medium transport direction when recording is performed by the recording section; a second feed roller pair that is positioned in the first direction which is in a downstream of the recording section and that feeds the medium in the first direction; a third feed roller pair that is positioned in the first direction which is in a downstream of the second feed roller pair and that is configured to rotate in a first rotational direction and in a second rotational direction opposite to the first rotational direction, in which the first rotational direction is a rotational direction when the medium is fed in the first direction and discharged; an upper transport route that is a medium transport route extending from the first feed roller pair to the third feed roller pair; a lower transport route that is a transport route positioned vertically below the upper transport route and that is a route in which the medium is transported toward the second direction, in which the medium is introduced by rotation of the third feed roller pair in the second rotational direction from an introducing port positioned in the second direction which is in an upstream of the third feed roller pair; a reverse route which is positioned in the second direction with respect to the first feed roller pair and coupled to the lower transport route and in which a surface of the medium is reversed; and a control section controlling the first feed roller pair, the second feed roller pair, and the third feed roller pair, in which the control section is configured to execute control of overlapping transportation in which a preceding medium and a following medium are transported in a state in which a rear end region of the preceding medium and a leading end region of the following medium overlap at least in a partial section in the upper transport route, and the control section determines an overlapping dimension Lk that is a dimension, by which the rear end region of the preceding medium and the leading end region of the following medium overlap, in accordance with a route dimension Ld from the third feed roller pair to an edge of the introducing port in the second direction, when executing the control of the overlapping transportation.

According to the present aspect, since the control section determines the overlapping dimension Lk in accordance with the route dimension Ld when executing the control of the overlapping transportation, it is possible to achieve both overlapping of the rear end region of the preceding medium and the leading end region of the following medium and switchback transportation of the preceding medium. Note that details thereof will be described later with reference to the drawings.

According to a second aspect, in the first aspect, the control section sets the overlapping dimension Lk to be less than or equal to a margin dimension Me of the rear end of the preceding medium in the medium transport direction.

According to the present aspect, since the control section sets the overlapping dimension Lk to be less than or equal to the margin dimension Me of the rear end of the preceding medium in the medium transport direction, in a case in which, when the leading end region of the following medium overlaps the rear end region of the preceding medium, recording is performed on the preceding medium, it is possible to avoid recording on the following medium.

According to a third aspect, in the second aspect, the control section sets the overlapping dimension Lk to be less than the route dimension Ld.

According to the present aspect, since the control section sets the overlapping dimension Lk to be less than the route dimension Ld, when switchback transportation of the preceding medium is performed, the rear end of the preceding medium is able to be appropriately fed to the lower transport route from the introducing port. Note that details thereof will be described later with reference to the drawings.

According to a fourth aspect, in any of the first to third aspects, the rear end of the preceding medium faces the introducing port when the leading end of the following medium arrives immediately in front of the third feed roller pair.

According to the present aspect, since the rear end of the preceding medium faces the introducing port when the leading end of the following medium arrives immediately in front of the third feed roller pair, the rear end of the preceding medium is able to be appropriately fed to the lower transport route.

According to a fifth aspect, in the second or fourth aspect, the control section sets the overlapping dimension Lk to be greater than the route dimension Ld, when causing the leading end region of the following medium to overlap the rear end region of the preceding medium, and, before a leading end of the preceding medium reaches the third feed roller pair, sets the overlapping dimension Lk to be less than the route dimension Ld by setting transporting speed of the preceding medium to be higher than transporting speed of the following medium.

According to the present aspect, even in a case in which the overlapping dimension Lk is set to be greater than the route dimension Ld when the leading end region of the following medium is caused to overlap the rear end region of the preceding medium, the overlapping dimension Lk is shortened by setting the transporting speed of the preceding medium to be higher than the transporting speed of the following medium afterward, it is therefore possible to improve throughput and achieve both overlapping transportation and switchback transportation of the preceding medium.

According to a sixth aspect, in the fifth aspect, the control section sets the overlapping dimension Lk when the leading end region of the following medium is caused to overlap the rear end region of the preceding medium to be less than a smaller dimension of a route dimension M1 and a route dimension M2, in which the route dimension M1 is a route dimension between the first feed roller pair and the second feed roller pair and the route dimension M2 is a route dimension between the second feed roller pair and the third feed roller pair.

According to the present aspect, since the control section sets the overlapping dimension Lk when the leading end region of the following medium is caused to overlap the rear end region of the preceding medium to be less than the smaller dimension of the route dimension M1 and the route dimension M2, a degree of freedom of control when the overlapping dimension Lk is shortened is improved. Note that details thereof will be described later with reference to the drawings.

According to a seventh aspect, in the fifth aspect, the control section sets the overlapping dimension Lk when the leading end region of the following medium is caused to overlap the rear end region of the preceding medium to be less than a route dimension between the second feed roller pair and the third feed roller pair, and sets the overlapping dimension Lk to be less than the route dimension Ld by setting the transporting speed of the preceding medium to be higher than the transporting speed of the following medium, when a region in which the rear end region of the preceding medium and the leading end region of the following medium overlap exists between the second feed roller pair and the third feed roller pair.

According to the present aspect, it is possible to suppress a deterioration in recording quality when the overlapping dimension Lk is shortened by setting the transporting speed of the preceding medium to be higher than the transporting speed of the following medium. Note that details thereof will be described later with reference to the drawings.

According to an eighth aspect, in the fifth aspect, the control section sets the overlapping dimension Lk when the leading end region of the following medium is caused to overlap the rear end region of the preceding medium to be less than a greater dimension of a route dimension M1 and a route dimension M2, in which the route dimension M1 is a route dimension between the first feed roller pair and the second feed roller pair and the route dimension M2 is a route dimension between the second feed roller pair and the third feed roller pair.

The disclosure will be specifically described below.

Note that, in the drawings, a direction extending along an X-axis is an apparatus width direction, which is a direction intersecting a sheet transport direction, that is, a sheet width direction. From the view of a user facing the apparatus front surface, a −X direction is a rightward direction with respect to the user, and a +X direction is a leftward direction with respect to the user.

A direction extending along a Y-axis is an apparatus depth direction. A +Y direction is a direction extending from the apparatus rear surface to the apparatus front surface and is a first direction. A −Y direction is a direction extending from the apparatus front surface to the apparatus rear surface and is a second direction. In the present embodiment, among the side surfaces surrounding the apparatus, the side surface on which an operation section 5 is provided is the apparatus front surface.

Moreover, a direction extending along a Z-axis is a vertical direction, a +Z direction is a vertically upward direction, and a −Z direction is a vertically downward direction.

Note that, in the present specification, transporting a recording sheet in the +Y direction is not limited to exactly meaning that the transport direction is in the +Y direction and means that the transport direction may include a +Z direction component or a −Z direction component as long as the transport direction includes a +Y direction component. Similarly, transporting a recording sheet in the −Y direction is not limited to exactly meaning that the transport direction is in the −Y direction and means that the transport direction may include the +Z direction component or the −Z direction component as long as the transport direction includes a −Y direction component.

In FIG. 1, an ink jet printer 1 that is an example of a recording apparatus is a so-called multifunctional peripheral that includes a scanner section 3 disposed on an apparatus main body 2. Hereinafter, the ink jet printer is abbreviated as "printer".

The apparatus main body 2 has a function of performing recording on a recording sheet that is an example of a medium, and the scanner section 3 has a function of reading a document. Note that the scanner section 3 includes an automatic document feeder (ADF) that automatically feeds a set document.

The apparatus main body 2 includes a transport route (described later) in which a recording sheet is transported and a recording head 9 (refer to FIG. 2) that is an example of a recording section and, in the present embodiment, detachably includes two medium accommodating cassettes, specifically, a first sheet cassette 51 and a second sheet cassette 52.

Moreover, the apparatus main body 2 is configured to enable sheets to be set on the first sheet cassette 51 and the second sheet cassette 52 and additionally to be set and fed from the apparatus rear surface. Reference numeral 7 denotes a cover that opens/closes a sheet setting opening (not illustrated) used for setting a sheet from a side of the apparatus rear surface.

The apparatus main body 2 includes, on the apparatus front surface, the operation section 5 with which various types of operation of the printer 1 are performed. The operation section 5 includes a display section and a plurality of operation buttons and is provided so as to be tiltable.

A discharge port 10 from which a recording sheet on which recording has been performed is discharged is provided on a lower side of the operation section 5, and a discharge tray 6 which receives the discharged recording sheet is provided on a lower side of the discharge port 10. The discharge tray 6 is provided so as to be able to take a state of being accommodated in the apparatus main body 2 as illustrated in FIG. 1 and a state of being drawn from the apparatus main body 2 (not illustrated).

Next, the transport route of a recording sheet will be described with reference to FIG. 2. Note that illustration of the second sheet cassette 52 is omitted in FIG. 2.

In the printer 1, regardless of a feeding route, the recording sheet is transported to a first feed roller pair 15 via a reverse roller 21 constituting a reverse route RR and is transported, by the first feed roller pair 15, to a recording region in which recording is performed by the recording head 9.

More specifically, as sheet feeding routes, the printer 1 includes a sheet feeding route K1 for feeding a recording sheet from the first sheet cassette 51, a sheet feeding route K2 for feeding a recording sheet from the second sheet cassette 52 below the first sheet cassette 51, and a sheet feeding route K3 for manually feeding a recording sheet from the upper rear side of the apparatus.

Moreover, as transport routes for transporting a recording sheet, the printer 1 includes a first transport route FR1, a second transport route FR2, a third transport route FR3, the reverse route RR, and a lower transport route SR. The first transport route FR1 and the second transport route FR2 constitute an upper transport route UR.

In the present embodiment, the first transport route FR1 is defined as a transport route between the first feed roller pair 15 and a second feed roller pair 40.

The second transport route FR2 is defined as a transport route between the second feed roller pair 40 and a third feed roller pair 46.

The third transport route FR3 is defined as a transport route between a driven roller 14*c* and the first feed roller pair 15.

The reverse route RR is defined as a transport route between a driven roller 14*a* and the driven roller 14*c*.

The lower transport route SR is defined as a transport route vertically below the upper transport route UR and a transport route extending between the third feed roller pair 46 and the driven roller 14*a* via a reverse drive roller 44.

In the sheet feeding route K1, a recording sheet is fed by a feed roller 11. The feed roller 11 is supported by a supporting member 12 that swings about a swing shaft 12*a*, and swing of the supporting member 12 causes the feed roller 11 to advance or retreat with respect to a recording sheet P accommodated in the first sheet cassette 51.

A similar feeding mechanism (not illustrated) is provided also in the second sheet cassette 52 (not illustrated in FIG. 2) provided under the first sheet cassette 51.

The reverse roller 21 is formed to have the largest diameter compared with other rollers and curves and reverses a recording sheet. Around the reverse roller 21, driven rollers 14*a*, 14*b*, 14*c*, and 14*d* are provided. A recording sheet fed via the sheet feeding route K1 or K2 is fed to the first feed roller pair 15 via the reverse route RR and the third transport route FR3.

A recording sheet fed via the sheet feeding route K3 is fed to the first feed roller pair 15 via the third transport route FR3.

The first feed roller pair 15 is configured by including a first drive roller 16 that is rotationally driven and a first driven roller 17 that is driven to rotate. In the present embodiment, the first drive roller 16 is configured such that a high friction layer is formed on an outer peripheral surface of a metal shaft, and a plurality of first driven rollers 17 are formed of a resin and provided along an axial direction of the first drive roller 16.

The recording sheet fed to the first feed roller pair 15 is nipped by the first drive roller 16 and the first driven rollers 17. When the first drive roller 16 rotates in a rotational direction C1, that is, normally rotates, the recording sheet is fed to a recording region facing the recording head 9, and recording is performed.

A carriage 8 including the recording head 9 is reciprocated in the X-axis direction by receiving power from a carriage drive motor 64 (refer to FIG. 3), while being guided by a carriage guide shaft 19 extending in the X-axis direction. In response to a moving operation of the carriage 8, the recording head 9 ejects ink onto the recording sheet. That is, the printer 1 is configured as a printer of a serial type that completes recording by alternately performing the ink ejecting operation according to a moving operation of the recording head 9 and a given amount of sheet transportation.

A supporting member 18 is provided at a position facing the recording head 9, and a recording sheet on which recording is performed by the recording head 9 is supported by the supporting member 18.

The second feed roller pair 40 that feeds the recording sheet on which recording has been performed to the downstream is provided downstream of the supporting member 18. The second feed roller pair 40 is configured by including a second drive roller 41 that is rotationally driven and a second driven roller 42 that is driven to rotate. In the present embodiment, the second drive roller 41 is a rubber roller, and the second driven roller 42 is a spur that is in point contact with the recording sheet. A plurality of pairs of the second drive roller 41 and the second driven roller 42 are provided in the X-axis direction with an appropriate gap therebetween. Note that the second feed roller pair 40 is a roller pair positioned downstream of the recording head 9 first.

When the second drive rollers 41 rotate in the rotational direction C1, that is, normally rotate, the recording sheet is further transported in the +Y direction.

The third feed roller pair 46 is provided downstream of the second feed roller pair 40. The third feed roller pair 46 is configured by including a third drive roller 47 that is rotationally driven and a third driven roller 48 that is driven to rotate.

In the present embodiment, the third drive roller 47 is a rubber roller, and the third driven roller 48 is a spur that is in point contact with the recording sheet. A plurality of pairs of the third drive roller 47 and the third driven roller 48 are provided in the X-axis direction with an appropriate gap therebetween.

When the third drive roller 47 constituting the third feed roller pair 46 rotates in the rotational direction C1, that is, normally rotates, the recording sheet on which recording has been performed is discharged in the +Y direction. Moreover, when the third drive roller 47 constituting the third feed roller pair 46 rotates in a rotational direction C2, that is, reversely rotates, the recording sheet is subjected to switchback transportation in the −Y direction.

Note that reference numeral 49 denotes a driven roller that is provided between the second feed roller pair 40 and the third feed roller pair 46 and suppresses floating of the recording sheet. In the present embodiment, the third driven roller 48 is a spur that is in point contact with the recording sheet. In particular, at a time of switchback transportation of a preceding sheet described later, floating of the preceding sheet is suppressed by the driven roller 49, and the preceding sheet is able to enter the lower transport route SR.

Note that, hereinafter, when a rotational direction of the first feed roller pair 15, the second feed roller pair 40, or the third feed roller pair 46 is described, rotation to transport a recording sheet in the +Y direction is defined as "normal rotation", and rotation to transport a recording sheet in the −Y direction is defined as "reverse rotation". The normal rotation of the third feed roller pair 46 is rotation in a first rotational direction, and the reverse rotation thereof is rotation in a second rotational direction.

In the printer 1 including the above-described transport routes, the feed roller 11 and the reverse roller 21 are driven by a first transport motor 65 (refer to FIG. 3), the first drive roller 16 and the second drive rollers 41 are driven by a second transport motor 66 (refer to FIG. 3), and the third drive rollers 47 and the reverse drive roller 44 described later are driven by a third transport motor 67 (refer to FIG. 3).

In the second transport route FR2 (upper transport route UR), a flap 39 is provided in the vicinity of the driven roller 49. By rotating around a rotational axis 39*a*, the flap 39 is able to switch between a state where an edge 39*b* in the +Y direction is lowered as indicated by a solid line in FIGS. 2 and 4 and a state where the edge 39*b* is raised as indicated by a two-dot chain line and reference numeral 39-1 in FIG. 4. The operation of the flap 39 will be described again later. Note that the flap 39 is driven by a flap drive source 75 (refer to FIG. 3).

Next, a control system of the printer 1 will be described with reference to FIG. 3. FIG. 3 is a block diagram illustrating the control system of the printer 1 according to the disclosure.

Figure 3:
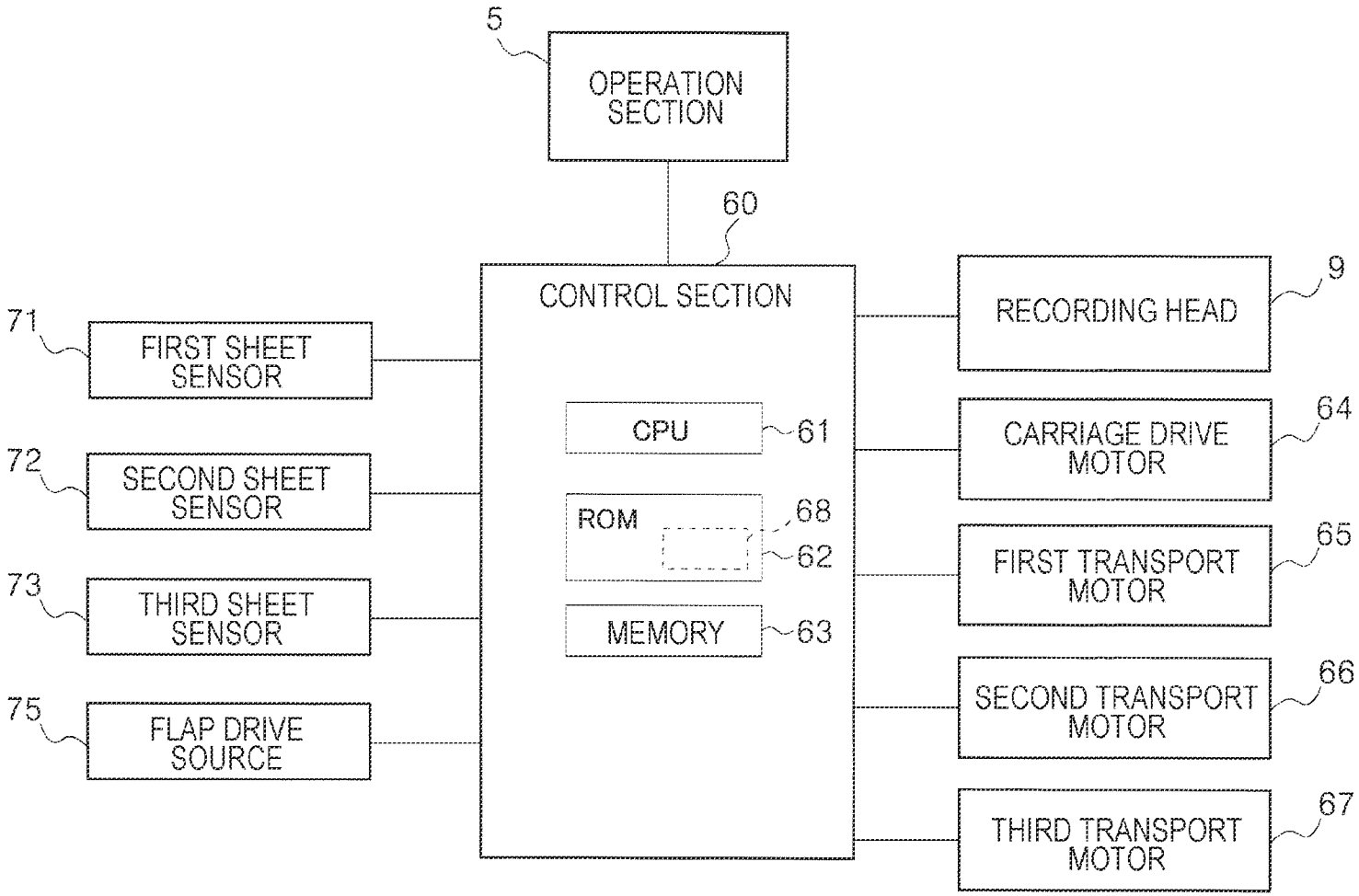
FIG. 3 is a block diagram illustrating a control system of the printer.

In FIG. 3, a control section 60 performs various types of control of the printer 1 such as feeding control of a recording sheet and recording control. A signal from the operation section 5 is input to the control section 60, and a signal for realizing display of the operation section 5, particularly, a user interface (UI) is transmitted from the control section 60 to the operation section 5.

The control section 60 controls motors of a carriage drive motor 64, the first transport motor 65, the second transport motor 66, and the third transport motor 67. In the present embodiment, all the motors are DC motors. Moreover, the control section 60 controls the recording head 9 and the above-described flap drive source 75.

Note that, although illustration is omitted, the printer 1 includes a sensor that detects rotational speed of each motor, and the control section 60 controls each motor based on a detection signal of the sensor. Moreover, based on the detection signal of the sensor, the control section 60 is able to grasp the rotational speed of each roller to be driven.

Moreover, detection signals from detecting units of a first sheet sensor 71, a second sheet sensor 72, and a third sheet sensor 73 are also input to the control section 60, and the control section 60 performs necessary control based on the detection signals.

Figure 2:
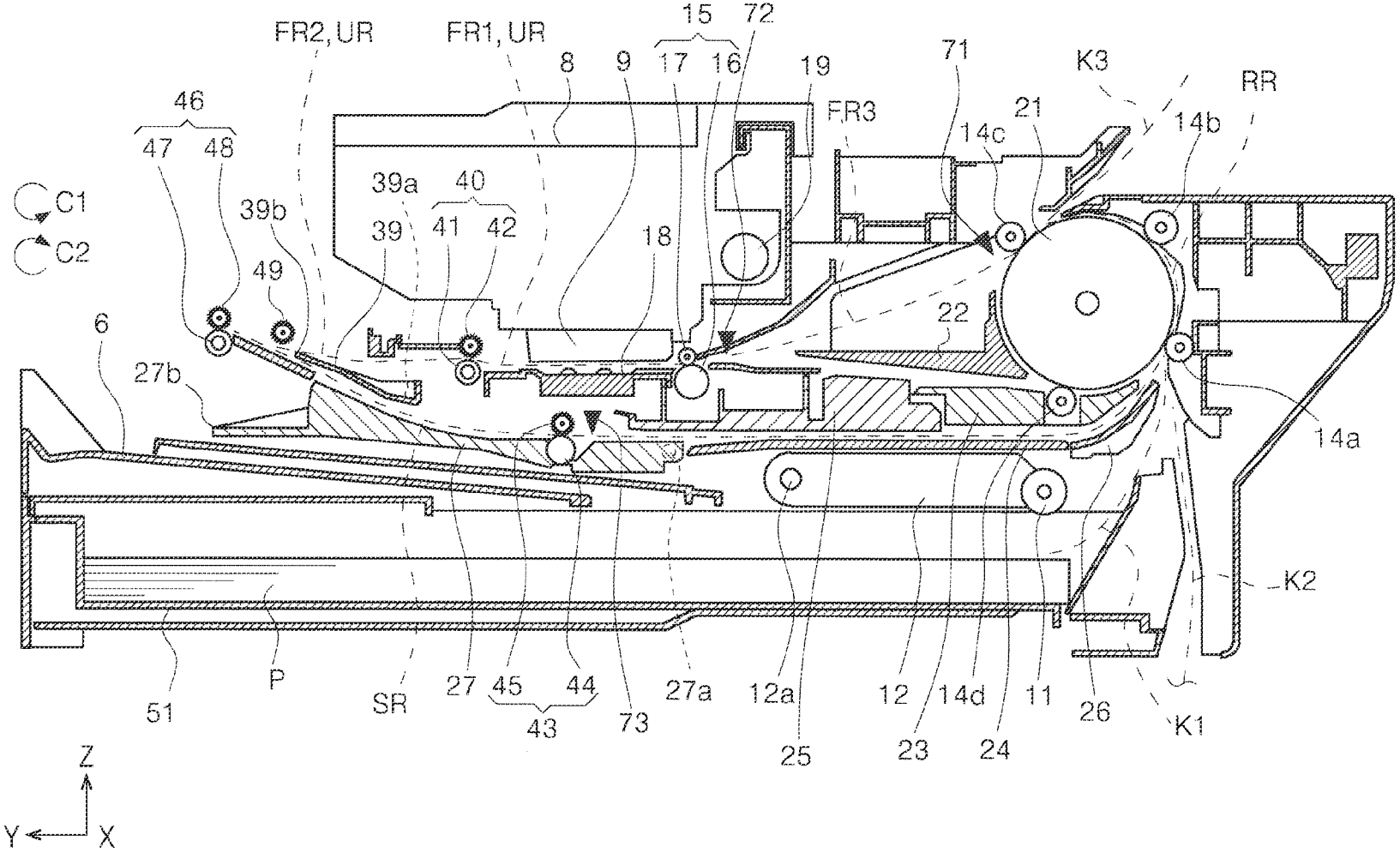
FIG. 2 illustrates an entire sheet transport route of the printer.

As illustrated in FIG. 2, the first sheet sensor 71 is a sensor provided in the +Y direction with respect to the driven roller 14*c*, the second sheet sensor 72 is a sensor provided in the −Y direction with respect to the first feed roller pair 15, and the third sheet sensor 73 is a sensor provided in the −Y direction with respect to a transporting roller pair 43. Each of the sensor enables passage of a leading end or rear end of a sheet at an arrangement position of the sensor to be detected. Each of the sensors is able to be configured by an optical sensor of, for example, a reflection type or a transmission type.

Based on the detection signal of each of the sheet sensors and a driving amount of each of the motors, that is, each of the rollers, the control section 60 is able to grasp a size of a transported recording sheet in a transport direction and a leading end position and a rear end position thereof in the transport route and also able to grasp a position of an overlapping region which will be described below and in which a preceding medium and a following medium overlap.

The control section 60 includes a CPU 61, ROM 62, and memory 63. The CPU 61 performs various types of arithmetic processing in accordance with a program 68 stored in the ROM 62 and controls operation of the entire printer 1. The memory 63 that is an example of a storage section is non-volatile memory which is readable and writable, and the control section 60 reads necessary data from the memory 63 or writes necessary data in the memory 63 in accordance with execution of the program 68.

Figure 4:
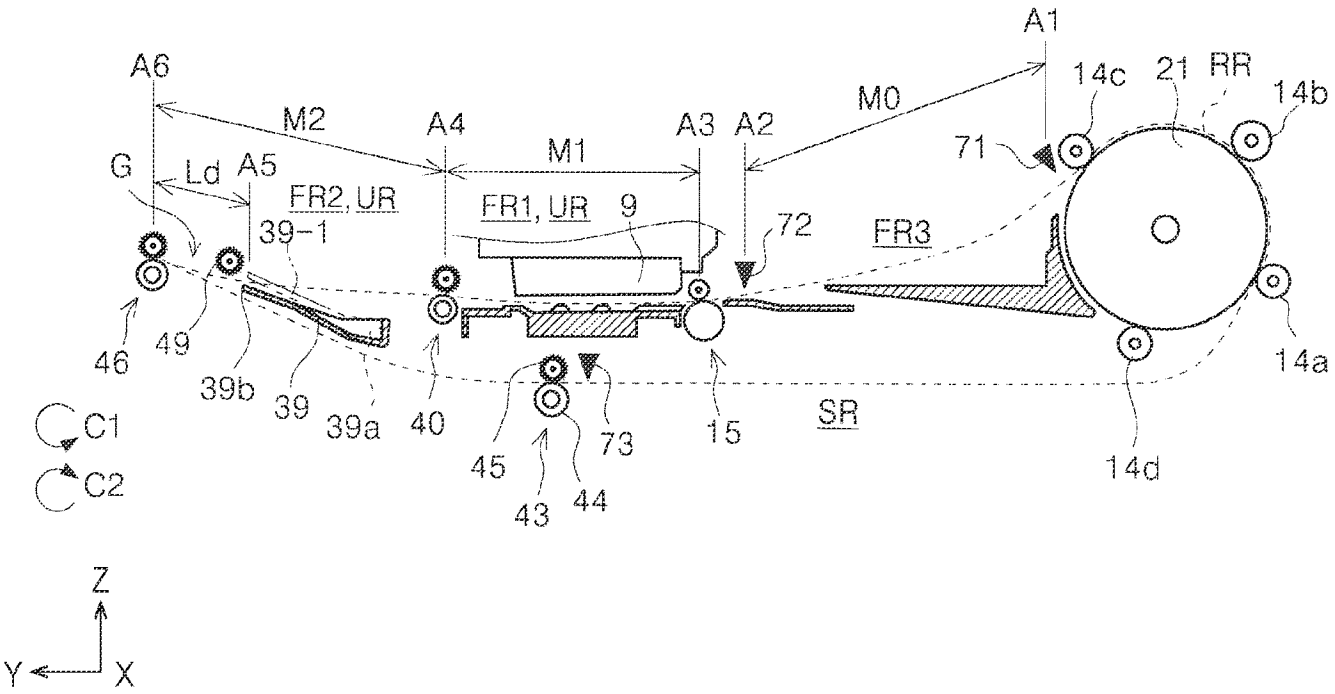
FIG. 4 illustrates a portion of the sheet transport route of the printer.
Figure 5:
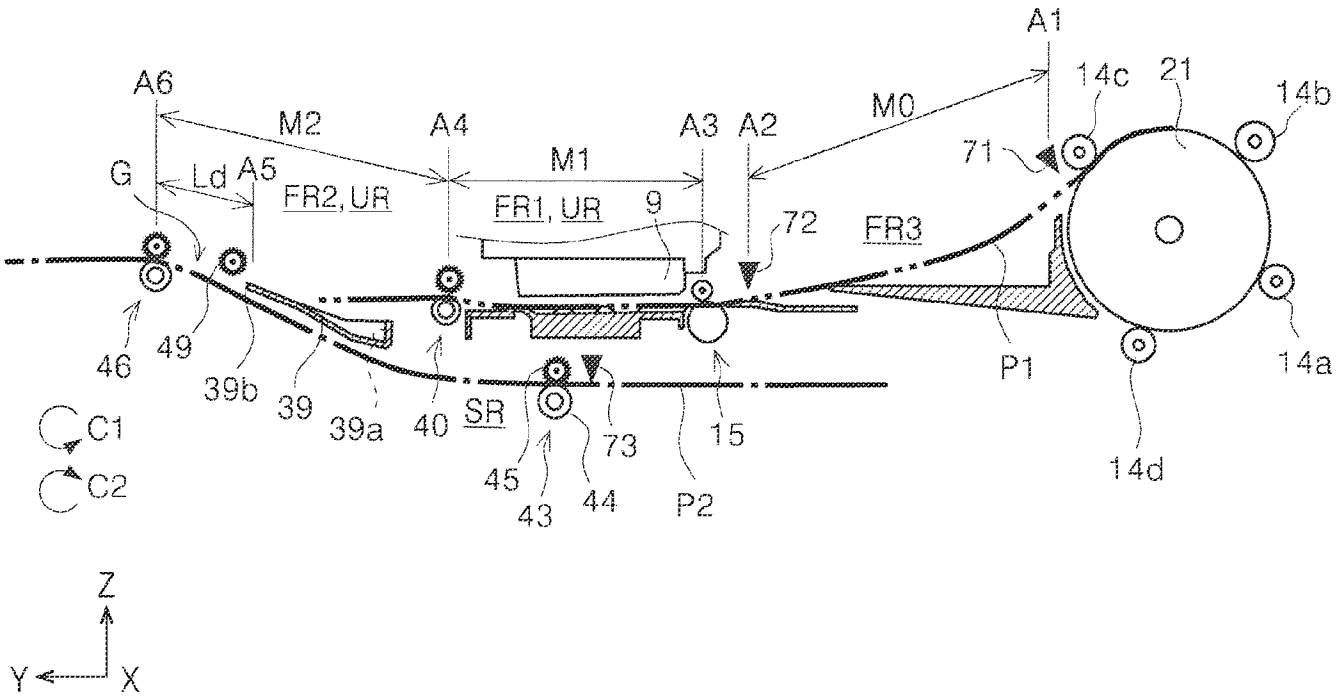
FIG. 5 illustrates a portion of the sheet transport route of the printer.

Next, transportation of a recording sheet when recording is performed on both surfaces of the recording sheet will be schematically described with reference to FIGS. 4 and 5. Hereinafter, a first surface of a recording sheet means a surface on which recording is performed first, and a second surface of the recording sheet means a surface on which recording is performed after the first surface.

First, positions on the transport route will be described with reference to FIG. 4. A position A1 is a position where the first sheet sensor 71 detects the recording sheet, and a position A2 is a position where the second sheet sensor 72 detects the recording sheet. Moreover, a position A3 is a position where the first feed roller pair 15 nips the recording sheet, a position A4 is a position where the second feed roller pair 40 nips the recording sheet, and a position A6 is a position where the third feed roller pair 46 nips the recording sheet. Moreover, a position A5 is a position of the edge 39*b* of the flap 39 in the second transport route FR2 (upper transport route UR). Note that, even when an orientation of the flap 39 changes, the position A5 hardly changes, but, to be exact, the position A5 is defined as a position of the edge 39*b* when the flap 39 is raised.

Further, reference numeral M0 denotes a route dimension between the position A1 and the position A2, reference numeral M1 denotes a route dimension between the position A3 and the position A4, that is, a route dimension of the first transport route FR1, reference numeral M2 denotes a route dimension between the position A4 and the position A6, that is, a route dimension of the second transport route FR2, and reference numeral Ld denotes a route dimension between the position A5 and the position A6.

When recording is performed on the second surface of the recording sheet, the recording sheet is transported in the upper transport route UR in the +Y direction until the rear end of the sheet arrives near the driven roller 49 after recording on the first surface is finished. When the rear end of the recording sheet passes through the edge 39*b* of the flap 39 in the +Y direction, the edge 39*b* of the flap 39 is raised, and the third feed roller pair 46 is reversely rotated. Thereby, the rear end of the recording sheet is fed to the lower transport route SR, and the recording sheet is transported toward the reverse route RR by the transporting roller pair 43 provided in the lower transport route SR. As an example, FIG. 5 illustrates a situation where a recording sheet P1, which has been fed to the lower transport route SR, is being transported toward the reverse route RR. Moreover, in FIG. 5, reference numeral P2 denotes a following medium on the first surface of which recording is being performed.

Note that reference numeral G denotes an introducing port positioned in the −Y direction with respect to the third feed roller pair 46. The introducing port G is formed between the edge 39*b* of the flap 39 and the third feed roller pair 46. The rear end of the recording sheet is fed to the lower transport route SR from the introducing port G. The edge 39*b* of the flap 39 serves as an edge of the introducing port G in the −Y direction, that is, the second direction.

The transporting roller pair 43 provided in the lower transport route SR is configured by including the reverse drive roller 44 that is rotationally driven and a reverse driven roller 45 that is driven to rotate. In the present embodiment, the reverse drive roller 44 is a rubber roller, and the reverse driven roller 45 is a spur that is in point contact with the recording sheet. A plurality of pairs of the reverse drive roller 44 and the reverse driven roller 45 are provided in the X-axis direction with an appropriate gap therebetween.

Note that a rotation regulating mechanism (not illustrated) is provided in a power transmission route from the third transport motor 67, which is a drive source of the reverse drive roller 44 constituting the transporting roller pair 43, to the reverse drive roller 44, and, due to the rotation regulating mechanism, the reverse drive roller 44 rotates in the rotational direction C2, by which the recording sheet is transported in the −Y direction, regardless of a rotational direction of the third transport motor 67. The rotation regulating mechanism is able to be configured by, for example, a mechanism including a one-way clutch or a mechanism including a planetary gear mechanism.

On the other hand, the third drive roller 47 rotates in the normal rotation direction C1, that is, normally rotates upon normal rotation of the third transport motor 67 and rotates in the reverse rotation direction C2, that is, reversely rotates upon reverse rotation of the third transport motor 67.

Figure 6:
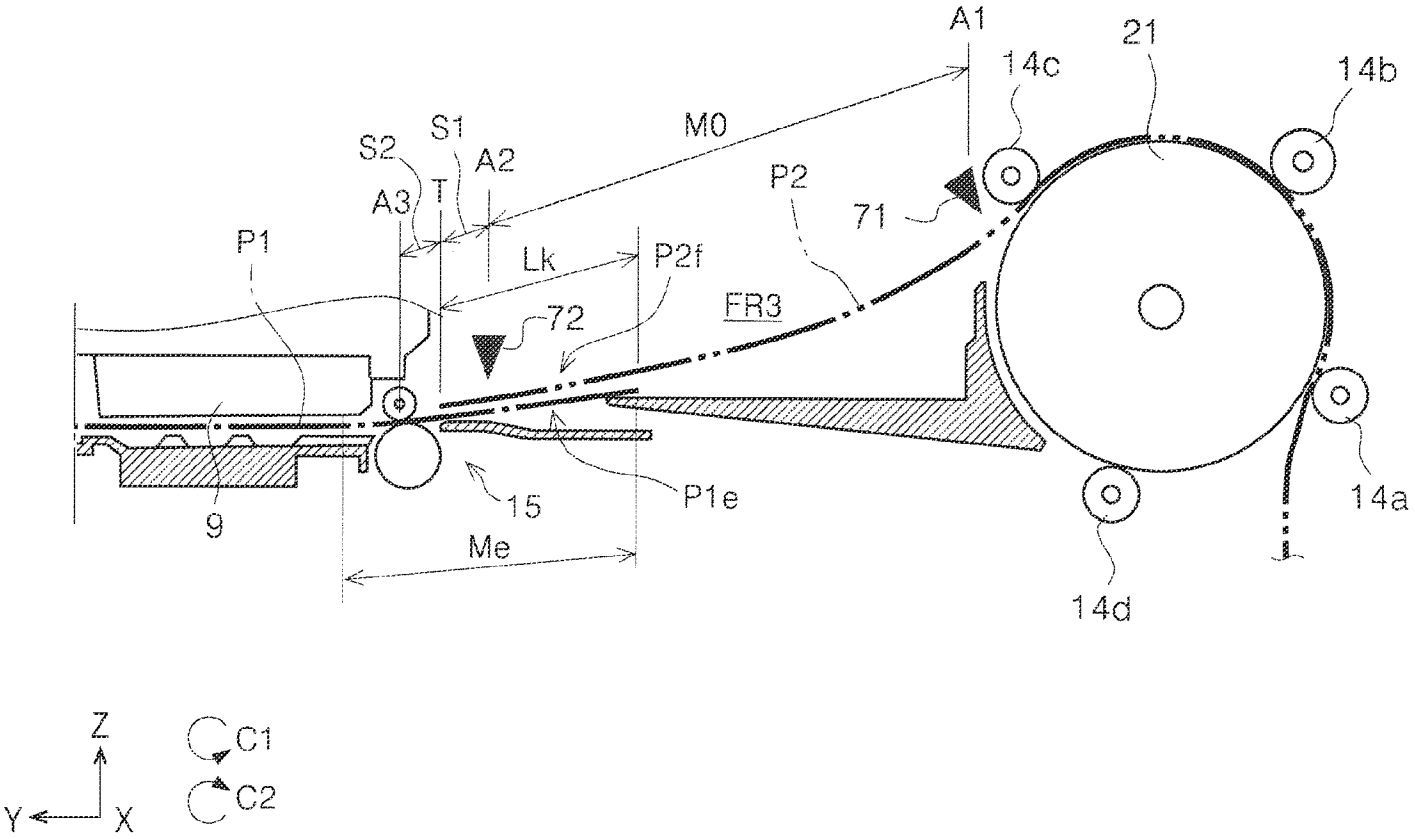
FIG. 6 illustrates a portion of the sheet transport route of the printer.

Next, control of overlapping transportation in which the preceding sheet P1 and the following sheet P2 are transported in a state where a rear end region of the preceding sheet P1 and a leading end region of the following sheet P2 overlap will be described with reference to FIG. 6 and the drawings subsequent thereto. When the rear end of the preceding sheet P1 passes through the position A1, at which detection is performed by the first sheet sensor 71, while recording is being performed on the preceding sheet P1, the control section 60 starts feeding the following sheet P2. When the leading end of the following sheet P2 is detected by the first sheet sensor 71, the control section 60 rotates the reverse roller 21 to execute an "overlapping operation" of causing a leading end region P2*f* of the following sheet P2 to overlap a rear end region Pie of the preceding sheet P1. In FIG. 6, reference numeral Lk denotes a dimension by which the leading end region P2*f* of the following sheet P2 overlaps the rear end region Pie of the preceding sheet P1. The dimension is hereinafter referred to as an overlapping dimension Lk.

After the leading end of the following sheet P2 is detected by the first sheet sensor 71, the control section 60 drives the reverse roller 21 so as to transport the following sheet P2 by setting a distance, which is obtained by adding the route dimension M0 between the second sheet sensor 72 and the first sheet sensor 71 and a predetermined distance S1, as a reference transporting amount=M0+S1. Thereby, the leading end of the following sheet P2 is transported to a standby position T, and the preceding sheet P1 and the following sheet P2 overlap.

The standby position T is set at a position apart from the position A3 of the first feed roller pair 15 in the −Y direction by a distance S2, and the distance S2 is set as a distance with which there is no possibility that the following sheet P2 in a standby state is nipped by the first feed roller pair 15. Accordingly, the predetermined distance S1 is calculated in advance based on the distance S2 such that the leading end of the following sheet P2 is positioned at the standby position T.

Although details will be described later, before the control section 60 executes the overlapping operation, the overlapping dimension Lk is determined in advance based on, for example, a content to be recorded on the preceding sheet P1, and the following sheet P2 stands by in a state where the leading end is at the standby position T, until the overlapping dimension Lk becomes the dimension determined in advance. Meanwhile, the moving operation of the recording head 9 and the given amount of transportation are alternately repeated for the preceding sheet P1, and the preceding sheet P1 advances in the +Y direction. When the overlapping dimension Lk becomes less than or equal to the dimension determined in advance, the control section 60 synchronously drives the reverse roller 21 and the first feed roller pair 15 and simultaneously transports the preceding sheet P1 and the following sheet P2 while keeping the state where the rear end region Pie of the preceding sheet P1 and the leading end region P2*f* of the following sheet P2 overlap. In the present specification, such simultaneous transportation of the preceding sheet P1 and the following sheet P2 is referred to as "overlapping transportation".

Note that, in a case in which the overlapping dimension Lk is less than or equal to the determined dimension at a time point when the leading end of the preceding sheet P2 arrives at the standby position T, the control section 60 immediately starts overlapping transportation.

Note that, regarding an overlapping way of the preceding sheet P1 and the following sheet P2 in the "overlapping operation", there are upper overlapping in which the leading end region P2*f* of the following sheet P2 overlaps an upper side of the rear end region Pie of the preceding sheet P1 and lower overlapping in which the leading end region P2*f* of the following sheet P2 overlaps a lower side of the rear end region Pie of the preceding sheet P1. The overlapping operation in the present embodiment is performed as the upper overlapping. The third transport route FR3 is formed such that a sheet advancing direction particularly in the downstream of the driven roller 14*c* extends upward as much as possible in order for that the leading end region P2*f* of the following sheet P2 easily overlaps the rear end region Pie of the preceding sheet P1.

Next, conditions of the overlapping dimension Lk, particularly, conditions under which the preceding sheet P1 is fed to the lower transport route SR, that is, conditions under which switchback transportation of the preceding sheet P1 is performed will be described.

First, as a first condition of the overlapping dimension Lk, the overlapping dimension Lk needs to be less than or equal to a margin dimension Me of the rear end of the preceding sheet P1. This is because, since the upper overlapping is performed in the present embodiment as described above, when the overlapping dimension Lk exceeds the margin dimension Me of the rear end of the preceding sheet P1, recording is performed on the following sheet P2 at a time of recording on the preceding sheet P1. Thus, the control section 60 sets the overlapping dimension Lk to be less than or equal to the margin dimension Me of the rear end of the preceding sheet P1.

Next, in FIG. 7, as a second condition of the overlapping dimension Lk, the overlapping dimension Lk needs to be less than the route dimension Ld between the position A6 of the third feed roller pair 46 and the position A5 of the edge 39*b* of the flap 39. Particularly, however great the margin dimension Me of the rear end of the preceding sheet P1 is, the overlapping dimension Lk is limited to being less than the route dimension Ld. Thereby, when switchback transportation of the preceding sheet P1 is performed, it is possible to appropriately feed the rear end of the preceding sheet P1 to the lower transport route SR from the introducing port G. This will be described below in detail.

In a case in which the rear end of the preceding sheet P1 is fed to the lower transport route SR from the introducing port G by switching rotation of the third feed roller pair 46 from normal rotation to reverse rotation, that is, in a case in which switchback transportation is performed, when the following sheet P2 is nipped by the third feed roller pair 46 together with the preceding sheet P1, the following sheet P2 is also reversed in the −Y direction due to the reverse rotation of the third feed roller pair 46, resulting in a possibility of occurrence of a jam of the following sheet P2.

Figure 7A:
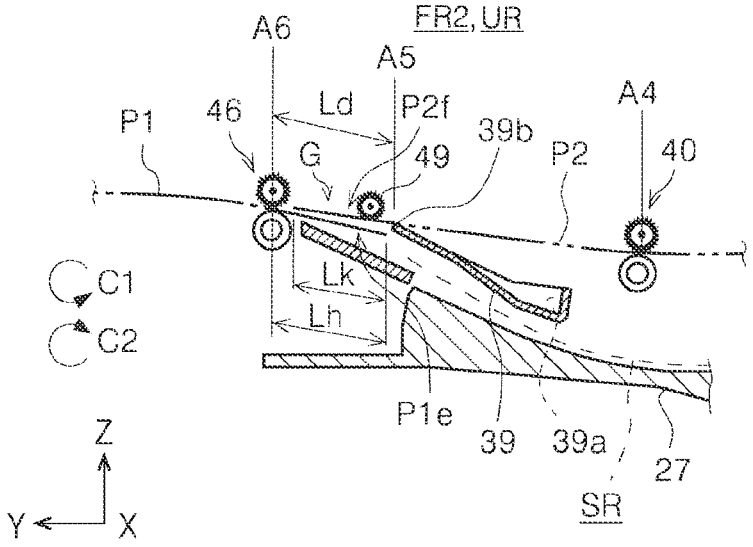
FIG. 7A illustrates a portion of the sheet transport route of the printer.

Accordingly, the condition is such that, when the rear end of the preceding sheet P1 is fed to the lower transport route SR from the introducing port G by switching the rotation of the third feed roller pair 46 from normal rotation to reverse rotation, the leading end of the following sheet P2 is not nipped by the third feed roller pair 46. In other words, when the leading end of the following sheet P2 arrives immediately in front of the third feed roller pair 46 as illustrated in FIG. 7A, the rear end of the preceding sheet P1 needs to face the introducing port G. When the third feed roller pair 46 is reversely rotated in such a state, it is possible to feed the rear end of the preceding sheet P1 to the lower transport route SR.

Figure 7B:
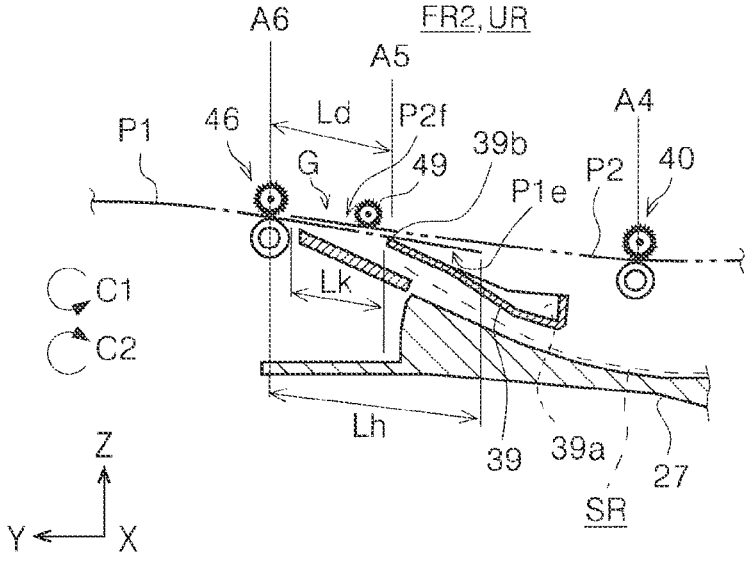
FIG. 7B illustrates a portion of the sheet transport route of the printer.

Hereinafter, a dimension from the rear end of the preceding sheet P1 to the third feed roller pair 46 when the leading end of the following sheet P2 arrives immediately in front of the third feed roller pair 46 is referred to as a "rear end protrusion dimension Lh" for convenience. Thus, when the rear end protrusion dimension Lh becomes greater than the route dimension Ld, the rear end of the preceding sheet P1 comes out of the introducing port G and is not able to enter the lower transport route SR. FIG. 7B illustrates a state where the rear end protrusion dimension Lh is greater than the route dimension Ld and where the rear end of the preceding sheet P1 comes out of the introducing port G.

Note that the rear end protrusion dimension Lh is substantially the same as the overlapping dimension Lk or slightly greater than the overlapping dimension Lk. In either case, when the overlapping dimension Lk becomes greater, the rear end protrusion dimension Lh becomes great.

That is, when the overlapping dimension Lk becomes great, the rear end of the preceding sheet P1 is not able to be appropriately fed to the lower transport route SR from the introducing port G. However, since the control section 60 sets the overlapping dimension Lk to be less than the route dimension Ld, when switchback transportation of the preceding sheet P1 is performed, it is possible to appropriately feed the rear end of the preceding sheet P1 to the lower transport route SR from the introducing port G.

However, the overlapping dimension Lk is able to be shortened afterward. This will be described below with reference to FIG. 8.

Figure 8A:
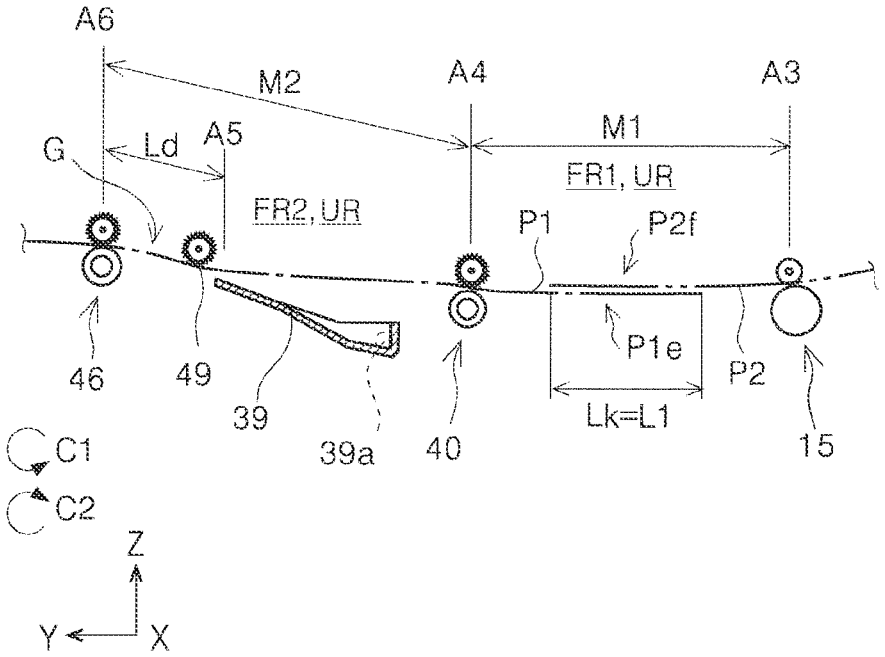
FIG. 8A illustrates a portion of the sheet transport route of the printer.

FIG. 8A illustrates a state where the overlapping dimension Lk=L1 is greater than the route dimension Ld. When transportation of the preceding sheet P1 and the following sheet P2 continues in this state, switchback transportation of the preceding sheet P1 is not able to be appropriately performed as described above.

Figure 8B:
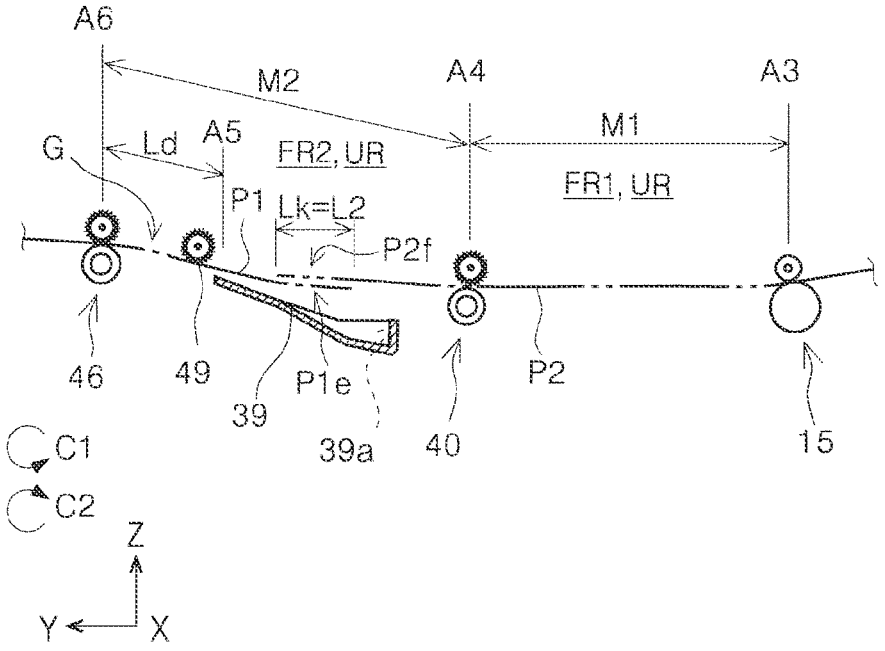
FIG. 8B illustrates a portion of the sheet transport route of the printer.

However, by transporting the preceding sheet P1 at higher speed than the following sheet P2 afterward, the overlapping dimension Lk is able to be made less than the route dimension Ld. FIG. 8B illustrates a state where the overlapping dimension Lk=L1 is kept until an overlapping region enters the second transport route FR2 and, when the overlapping region enters the second transport route FR2, transporting speed of the preceding sheet P1 is set to be higher than transporting speed of the following sheet P2 to thereby set the overlapping dimension Lk to be a dimension L2 smaller than the dimension L1. Needless to say, the dimension L2 is less than the route dimension Ld.

In the present embodiment, since a drive source of the third feed roller pair 46 and a drive source of the second feed roller pair 40 are separately provided, by setting transporting speed of the third feed roller pair 46 to be higher than transporting speed of the second feed roller pair 40 when the overlapping region enters the second transport route FR2, the transporting speed of the preceding sheet P1 is able to be made higher than the transporting speed of the following sheet P2.

However, when the overlapping dimension Lk is shortened in the second transport route FR2, the initial overlapping dimension Lk=L1 needs to be less than the route dimension M2 of the second transport route FR2.

Note that the sheet transporting speed here is not necessarily limited to sheet transporting speed when the respective roller pairs continuously rotate. For example, even in a case in which the second feed roller pair 40 and the third feed roller pair 46 that continuously rotate are the same in sheet transporting speed, when drive of the second feed roller pair 40 includes a stop period, a sheet transporting amount of the third feed roller pair 46 per unit time is consequently able to be made larger than a sheet transporting amount of the second feed roller pair 40. Thereby, the transporting speed of the third feed roller pair 46 becomes higher than the transporting speed of the second feed roller pair 40.

Note that, a configuration for making transporting speed of a recording sheet of the respective roller pairs different is able to be realized not only by using separate drive sources of the respective roller pairs as described above but also by enabling power transmission routes from one drive source to the respective rollers to be switched such that, upon switch between the power transmission routes, a reduction ratio of power transmission changes or power transmission to one of the roller pairs is not performed.

As described above, even in a case in which the overlapping dimension Lk is greater than the route dimension Ld when the leading end region P2*f* of the following sheet P2 overlaps the rear end region Pie of the preceding sheet P1, by setting the transporting speed of the preceding sheet P1 to be higher than the transporting speed of the following sheet P2 afterward, it is possible to shorten the overlapping dimension Lk. Hereinafter, such transportation is referred to as "overlapping transportation with shortening overlapping dimension". By performing the overlapping transportation with shortening overlapping dimension, it is possible to improve throughput and achieve both overlapping transportation and switchback transportation. Note that overlapping transportation in which the overlapping dimension Lk is not shortened is hereinafter referred to as "overlapping transportation without shortening overlapping dimension".

Note that, when it is possible to make transporting speed of the first feed roller pair 15 different from the transporting speed of the second feed roller pair 40 and the third feed roller pair 46, it is also possible to shorten the overlapping dimension Lk not in the second transport route FR2 but in the first transport route FR1. In this case, the initial overlapping dimension Lk=L1 needs to be less than the route dimension M1 of the first transport route FR1.

Moreover, when the configuration is able to be such that all the transporting speed of the first feed roller pair 15, the transporting speed of the second feed roller pair 40, and the transporting speed of the third feed roller pair 46 are different, the initial overlapping dimension Lk=L1 is suitable to be less than the shorter dimension of the route dimension M1 of the first transport route FR1 and the route dimension M2 of the second transport route FR2. Thereby, it is possible to shorten the overlapping dimension Lk in both the first transport route FR1 and the second transport route FR2, resulting in improvement in degree of freedom of control.

Note that, when the overlapping dimension Lk is greater than the greater dimension of the route dimension M1 of the first transport route FR1 and the route dimension M2 of the second transport route FR2, the overlapping dimension Lk is not able to be shortened in either the first transport route FR1 or the second transport route FR2. Accordingly, the control section 60 sets the overlapping dimension Lk to be less than the greater dimension of the route dimension M1 and the route dimension M2.

Note that, by shortening the overlapping dimension Lk not in the first transport route FR1 but in the second transport route FR2, a gap between the following sheet P2 and the recording head 9 is less likely to change especially when recording is performed on the leading end region P2*f* of the following sheet P2, and a deterioration in recording quality when recording is performed on the following sheet P2 is able to be suppressed, and thus it is more suitable to shorten the overlapping dimension Lk in the second transport route FR2.

Figure 9:
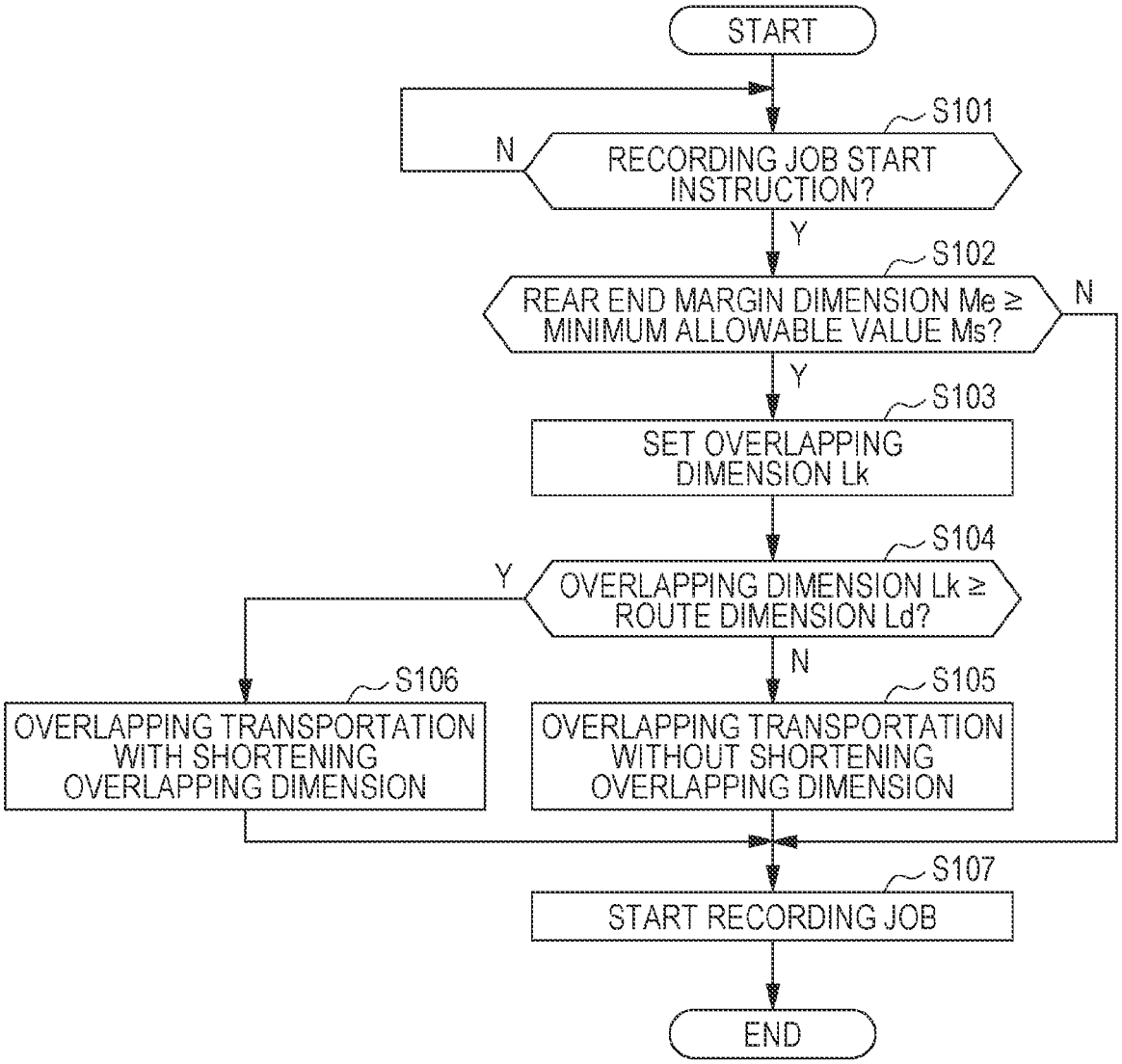
FIG. 9 is a flowchart illustrating a flow of processing of overlapping transportation.

To summarize the foregoing control with reference to FIG. 9, when receiving a recording job start instruction (Yes in step S101), the control section 60 judges whether or not there is a margin in the rear end of the sheet, more specifically, whether or not a rear end margin dimension Me is more than or equal to a minimum allowable value Ms (step S102). This is because, in a case in which the rear end margin dimension Me is less than the minimum allowable value Ms (No in step S102), when overlapping transportation is performed, there is a possibility that the rear end of the preceding sheet P1 and the leading end of the following sheet P2 collide and that an overlapping order changes. Thus, when the rear end margin dimension Me is less than the minimum allowable value Ms, overlapping transportation is not performed, and the preceding sheet P1 and the following sheet P2 are transported with a predetermined gap formed between the rear end of the preceding sheet P1 and the leading end of the following sheet P2.

When the rear end margin dimension Me is more than or equal to the minimum allowable value Ms (Yes in step S102), the overlapping dimension Lk is set within a range not exceeding the rear end margin dimension Me (step S103). Specifically, a dimension obtained by subtracting a given margin (for example, 2 to 3 mm) from the rear end margin dimension Me is able to be set as the overlapping dimension Lk.

Next, the control section 60 judges whether or not the overlapping dimension Lk is more than or equal to the route dimension Ld (step S104). When the overlapping dimension Lk is more than or equal to the route dimension Ld (Yes in step S104), the control section 60 selects overlapping transportation with shortening overlapping dimension (step S106). When the overlapping dimension Lk is less than the route dimension Ld (No in step S104), the control section 60 selects overlapping transportation without shortening overlapping dimension (step S105).

Note that, when recording is performed on three or more recording sheets, judgment of step S102 to S106 is made for each relationship between a preceding sheet and a following sheet. For example, when recording is performed on three recording sheets, judgment is made for the first sheet and the second sheet and is further made for the second sheet and the third sheet.

As above, for each relationship between a preceding sheet and a following sheet, whether or not to execute overlapping transportation is judged. When overlapping transportation is performed, the overlapping dimension Lk is set, and whether or not to perform overlapping transportation with shortening overlapping dimension is judged, and then the control section 60 starts a recording job (step S107)

As above, when executing control of overlapping transportation in which the preceding sheet P1 and the following sheet P2 are transported in a state where the rear end region Pie of the preceding sheet P1 and the leading end region P2*f* of the following sheet P2 overlap at least in a partial section in the upper transport route UR, the control section 60 determines the overlapping dimension Lk in accordance with the route dimension Ld, and it is therefore possible to achieve both overlapping of the rear end region Pie of the preceding sheet P1 and the leading end region P2*f* of the following sheet P2 and switchback transportation.

It is to be understood that the disclosure is not limited to the embodiment described above, that various modifications can be made within the scope of the disclosure described in the claims, and that these modifications are included within the scope of the disclosure.

What is claimed is:

1. A recording apparatus comprising:

a recording section performing recording on a medium;

a first feed roller pair that is positioned in a second direction and feeds the medium in a first direction, the second direction being in an upstream of the recording section and being opposite to the first direction which is a medium transport direction when recording is performed by the recording section;

a second feed roller pair that is positioned in the first direction which is in a downstream of the recording section and that feeds the medium in the first direction;

a third feed roller pair that is positioned in the first direction which is in a downstream of the second feed roller pair and that is configured to rotate in a first rotational direction and in a second rotational direction opposite to the first rotational direction, the first rotational direction being a rotational direction when the medium is fed in the first direction and discharged;

an upper transport route that is a medium transport route extending from the first feed roller pair to the third feed roller pair;

a lower transport route that is a transport route positioned vertically below the upper transport route and that is a route in which the medium is transported toward the second direction, the medium being introduced by rotation of the third feed roller pair in the second rotational direction from an introducing port positioned in the second direction which is in an upstream of the third feed roller pair;

a reverse route which is positioned in the second direction with respect to the first feed roller pair and coupled to the lower transport route and in which a surface of the medium is reversed; and a control section controlling the first feed roller pair, the second feed roller pair, and the third feed roller pair, wherein the control section is configured to execute control of overlapping transportation in which a preceding medium and a following medium are transported in a state in which a rear end region of the preceding medium and a leading end region of the following medium overlap at least in a partial section in the upper transport route, and the control section determines an overlapping dimension Lk that is a dimension, by which the rear end region of the preceding medium and the leading end region of the following medium overlap, in accordance with a route dimension Ld from the third feed roller pair to an edge of the introducing port in the second direction, when executing the control of the overlapping transportation.

2. The recording apparatus according to claim 1, wherein the control section sets the overlapping dimension Lk to be less than the route dimension Ld.

3. The recording apparatus according to claim 1, wherein the rear end of the preceding medium faces the introducing port when the leading end of the following medium arrives immediately in front of the third feed roller pair.

4. The recording apparatus according to claim 1, wherein the control section sets the overlapping dimension Lk to be less than or equal to a margin dimension Me of the rear end of the preceding medium in the medium transport direction.

5. The recording apparatus according to claim 4, wherein the control section sets the overlapping dimension Lk to be greater than the route dimension Ld, when causing the leading end region of the following medium to overlap the rear end region of the preceding medium, and, before a leading end of the preceding medium reaches the third feed roller pair, sets the overlapping dimension Lk to be less than the route dimension Ld by setting transporting speed of the preceding medium to be higher than transporting speed of the following medium.

6. The recording apparatus according to claim 5, wherein the control section sets the overlapping dimension Lk when the leading end region of the following medium is caused to overlap the rear end region of the preceding medium to be less than a smaller dimension of a route dimension M1 and a route dimension M2, the route dimension M1 being a route dimension between the first feed roller pair and the second feed roller pair and the route dimension M2 being a route dimension between the second feed roller pair and the third feed roller pair.

7. The recording apparatus according to claim 5, wherein the control section sets the overlapping dimension Lk when the leading end region of the following medium is caused to overlap the rear end region of the preceding medium to be less than a route dimension between the second feed roller pair and the third feed roller pair, and sets the overlapping dimension Lk to be less than the route dimension Ld by setting the transporting speed of the preceding medium to be higher than the transporting speed of the following medium, when a region in which the rear end region of the preceding medium and the leading end region of the following medium overlap exists between the second feed roller pair and the third feed roller pair.

8. The recording apparatus according to claim 5, wherein the control section sets the overlapping dimension Lk when the leading end region of the following medium is caused to overlap the rear end region of the preceding medium to be less than a greater dimension of a route dimension M1 and a route dimension M2, the route dimension M1 being a route dimension between the first feed roller pair and the second feed roller pair and the route dimension M2 being a route dimension between the second feed roller pair and the third feed roller pair.

* * * * *